United States Patent [19]

Cairns et al.

[11] 4,348,843

[45] Sep. 14, 1982

[54] MOBILE HOME SUPPORT SYSTEM

[76] Inventors: Neil S. Cairns, 31361 McWade St., Homeland, Calif. 92348; Loyd Hendershott, 215 N. "A" St., Perris, Calif. 92370

[21] Appl. No.: 174,752

[22] Filed: Aug. 4, 1980

[51] Int. Cl.[3] ..... E04H 9/02

[52] U.S. Cl. ..... 52/167; 52/79.1; 52/143; 52/299; 52/632; 52/DIG. 11

[58] Field of Search ..... 52/167, 23, 299, 143, 52/79.1, 79.7, 79.8, 126, 632

[56] References Cited

U.S. PATENT DOCUMENTS

| | | | |
|---|---|---|---|
| 1,961,967 | 6/1934 | Goranson | 52/632 |
| 3,791,087 | 2/1974 | Sigal | 52/79.9 X |
| 4,125,975 | 11/1978 | Soble | 52/126 |
| 4,214,410 | 7/1980 | Mitsueda | 52/143 |
| 4,261,149 | 4/1981 | Gustafson | 52/DIG. 11 |

FOREIGN PATENT DOCUMENTS

| | | | |
|---|---|---|---|
| 2514623 | 10/1976 | Fed. Rep. of Germany | 52/126 |
| 2418319 | 10/1979 | France | 52/126 |

*Primary Examiner*—Alfred C. Perham

*Attorney, Agent, or Firm*—Fulwider, Patton, Rieber, Lee & Utecht

[57] ABSTRACT

A mobile house support system is described which provides an adjustable foundation for mobile homes which is resistant to earth movements such as is caused by earthquakes and to high wind forces. The support system unitizes a double wide mobile home by securing each section of the structure to the support members. Multiple I-beams are secured at right angles to the main support structure of the mobile home, a plurality of adjustable legs are carried by the support beam and connected to the main support structure of the mobile home and bearing blocks support the legs.

2 Claims, 7 Drawing Figures

MOBILE HOME SUPPORT SYSTEM

BACKGROUND OF THE INVENTION

1. Field of the Invention

This invention concerns mobile home support systems, and more particularly support systems which are particularly adapted to unitizing a double-wide mobile home and at the same time providing foundation support means resistant to earthquakes, without the need for tie-down supports.

2. Description of Prior Art

Heretofore, mobile home foundations have usually comprised concrete piers on which the mobile home was placed for support. The obvious deficiency of such support means is its susceptability to lateral movements caused by earthquakes and high wind forces. Tie-downs, used in conjunction with the support means, are somewhat makeshift in nature, in that they do not provide adequate resistance to pier failure to the movements of the earth caused by earthquakes.

Sometimes tie-downs create structural damage to the mobile home by force loads impinging upon the points of connection to the mobile home.

Other prior art devices used foundations permanently affixed to the ground which circumstance would then require that the mobile home be assessed as though it were real property. In order to avoid that problem, which can be a serious economic burden to the mobile home owner, portable foundations must be utilized.

Still other prior art devices utilized foundations for each half of a double-wide mobile home without a structural relationship existing between the foundations.

As a result, unusually large forces on either half of the double-wide mobile home, such as might be induced by earthquake, would tend to separate the two halves.

The present invention overcomes the deficiencies of the prior art system in that it provides a foundation which insures a high degree of stability between the two halves of a double-wide mobile home.

Another object of the present invention is to provide a portable system thereby avoiding assessment of real property taxes on the mobile home.

Another object of the present invention is to provide a foundation to support the mobile home structure adequately so as to resist any lateral movements of the foundation resulting from earthquakes; also resisting overturning forces produced by strong winds.

It is still a further object of the present invention to provide a support system in which costs and complexity are kept to a minimum.

Another object of the present invention is to provide adjustable support means to accommodate various ground contours.

SUMMARY OF THE INVENTION

These and other objects of the invention are provided by a plurality of adjustable legs mounted on two I-beams, one of which is secured to one end of the mobile home undercarriage structure and the second of which is secured to the other end. Each support I-beam serves to tie both halves of a double-wide mobile home together.

Lateral stabilization is achieved by securing the upper end of the adjustable leg to the mobile home main frame and the lower end of the leg to a bearing block secured with pins, adjusting the legs to the ground contour.

DETAILED DESCRIPTION

Figure 1:
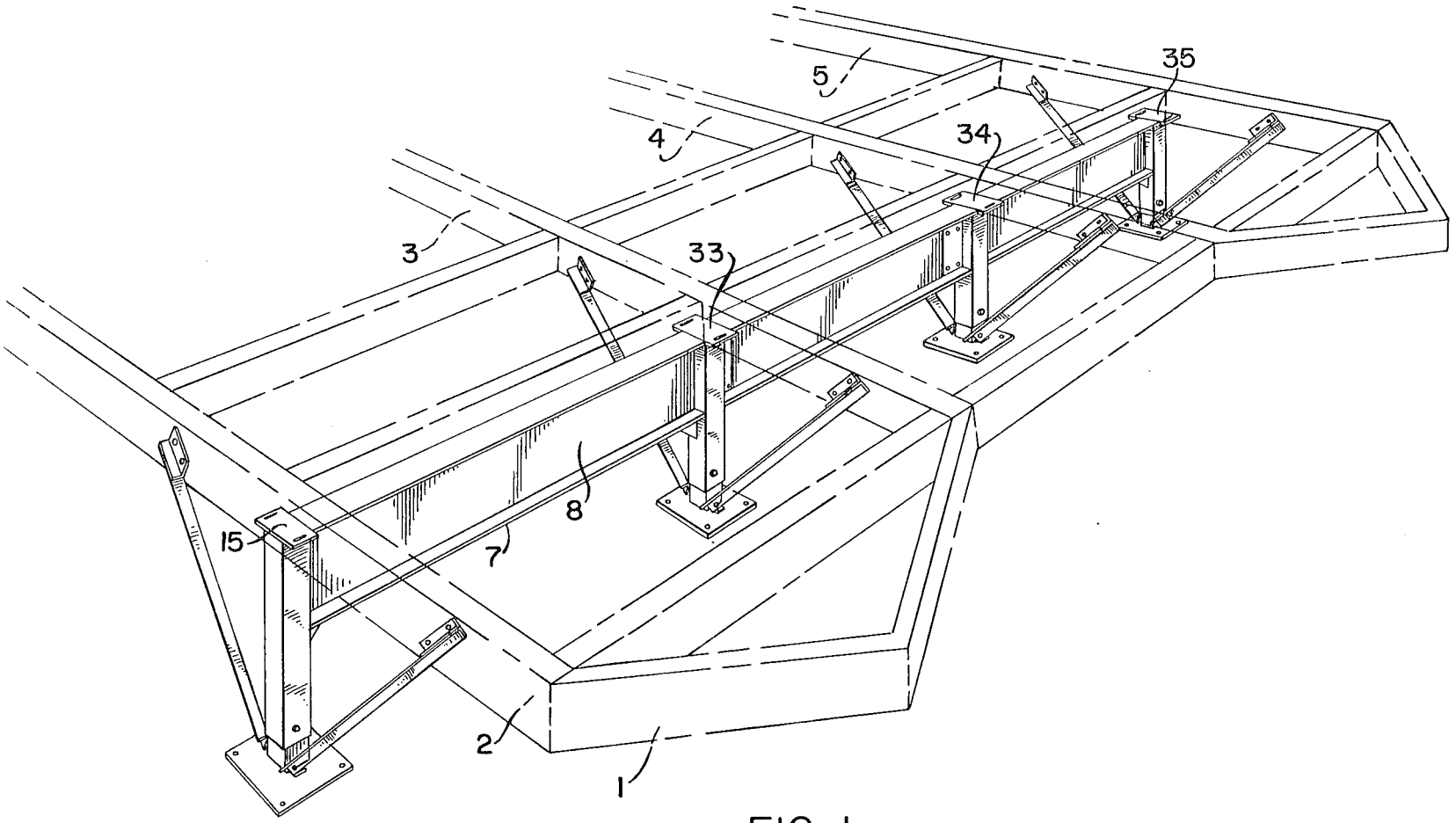
FIG. 1 is a perspective view showing the front of a double wide mobile home undercarriage supported on the support system.

The first embodiment of this invention is shown in FIG. 1 in which a portion of a double-wide mobile home 1 is shown with its undercarriage support members 2, 3, 4 and 5 supported on the top of I-Beam 8 at 15, 33, 34 and 35.

In a typical mobile home installation, primary support structures for the mobile home, not shown, will be in place and the earthquake protection system will then be installed as shown in FIG. 1.

The earthquake protection system will generally have a minimum of 2 support structures, one of which is shown at 7 in FIG. 1, located at a distance of L/5 from each end of the mobile home chassis where L is the total length of the mobile home chassis.

Figures 2, 7:
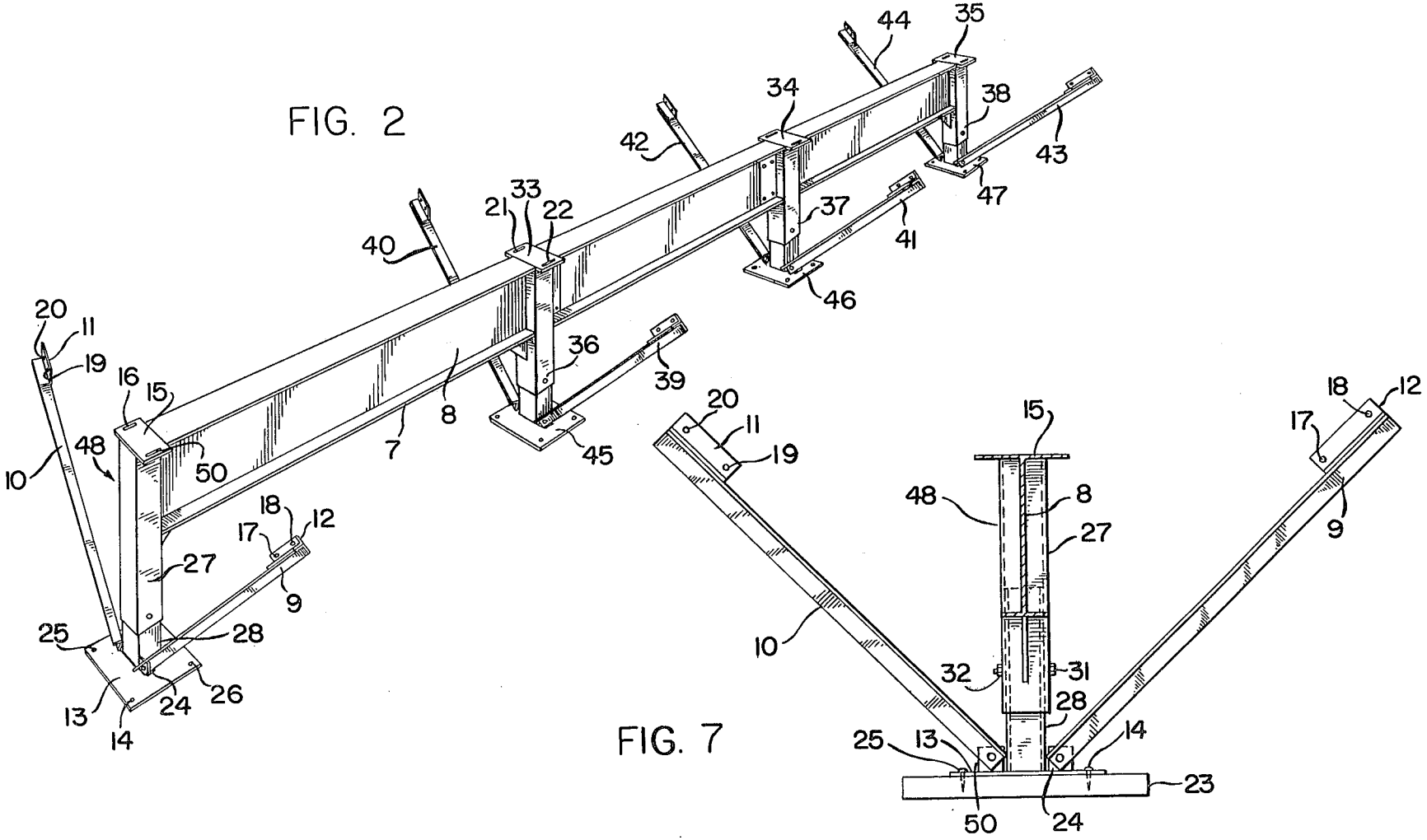
FIG. 2 is a perspective view showing one of the I-Beams carried on the adjustable stanchions.
FIG. 7 is a detailed side view showing the adjustable stanchion secured to the I-Beam and bearing block, with support arms connected to the inner telescoping section of the stanchion.

Each structure 7 of the earthquake protection system includes four telescoping stanchions 27, 36, 37 and 38 shown in FIG. 2, support arms 9, 10, 39, 40, 41, 42, 43 and 44, support bases 13, 45, 46 and 47, which bases are carried on weight bearing blocks shown at 23 in FIG. 7. An I-Beam 8 serves to tie the stanchions together and also serves to support the mobile home undercarriage, to be described hereafter.

A detailed view of the stanchion and I-Beam assembly is shown in FIG. 7. The I-Beam 8 is carried within the hollow stanchion 48, and has telescoping section 28 within the larger section 27. The stanchion is adjusted to the proper height such that the top surfact 15 of the I-Beam rests on the mobile home undercarriage. Once the proper height has been adjusted for, the outer and inner sections of the stanchion are secured by bolt 31 and nut 32.

The next step in securing the system is to connect lower ends of the angle iron support arms 9, 10 to right angle connectors 24 and 50 and the upper ends thereof 11, 12 are fitted against the undercarriage structure 2 of FIG. 1. The angle iron support arms are then bolted to the undercarriage structure by placing bolts through the holes at 17, 18, 19, 20.

Each telescoping stanchion is carried by plate 13 which is secured to the weight bearing block 23 by pins 14, 25 26 and 49.

The top of each stanchion 15, FIG. 2 is secured to the undercarriage support beams by bolts inserted through holes 16, 50 and secured to the undercarriage by nuts.

Figure 3:
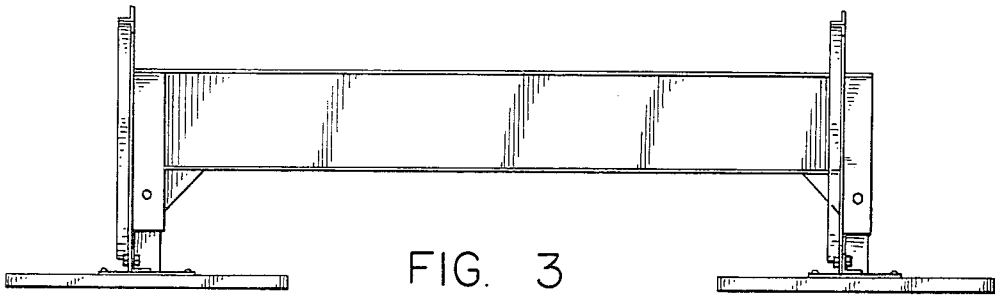
FIG. 3 is a front view of a I-Beam carried on the adjustable stanchions for a single-wide mobile home.
Figure 4:
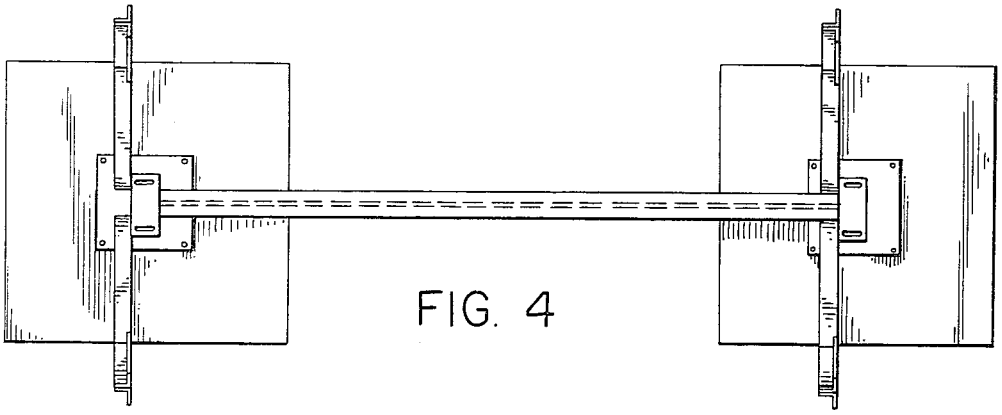
FIG. 4 is a top view of the structure shown in FIG. 3.
Figure 5:
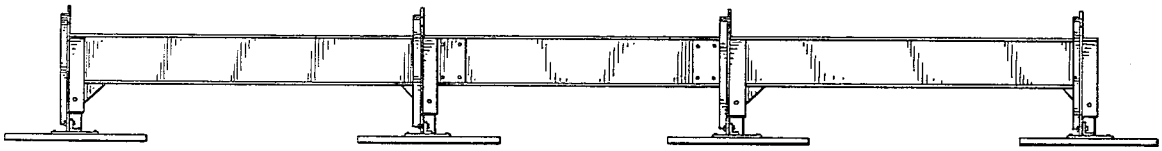
FIG. 5 is a front view of an I-Beam, carried on the adjustable stanchions for a double-wide mobile home.
Figure 6:
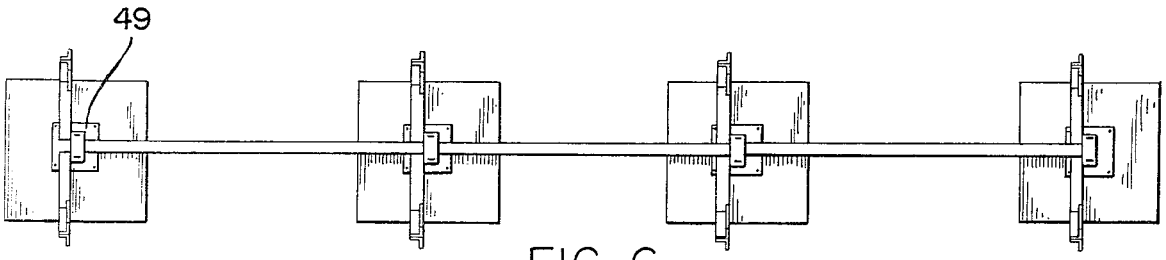
FIG. 6 is a top view of the structure shown in FIG. 5.

The preferred embodiment used on a double-wide mobile home is shown in FIGS. 1 and 2. FIGS. 3 and 4 disclose top and front views of an embodiment for a single-wide mobile home.

The invention serves to tie the mobile home structure to the earthquake protection system so that vibrations caused by an earthquake will not allow the mobile home to fall to the ground, as they have oftentimes done, heretofore.

We claim as our invention:

1. An earthquake protection system for a mobile home having a frame, the combination comprising:

support means for supporting said mobile home frame on the ground, said support means including a plurality of telescoping stanchions carried on an I-beam, spaced along the bottom of said mobile home and support on the ground, each of said stanchions comprising an outer telescoping section, support arms and a base, and each bottom of said support arms rotatably connected to the inner telescoping section of said stanchion and the tops of said support arms secured to the mobile home frame.

2. An earthquake protection system according to claim 1, wherein each support means include two telescoping stanchions adapted for use with a single-wide mobile home.

* * * * *